US006854301B1

(12) United States Patent
Romanski

(10) Patent No.: US 6,854,301 B1
(45) Date of Patent: Feb. 15, 2005

(54) EXTENDED NIP PRESS FOR THE LEATHER INDUSTRY

(75) Inventor: Eric Romanski, Clifton Park, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/823,007

(22) Filed: Apr. 13, 2004

(51) Int. Cl.[7] ..... C14B 1/34
(52) U.S. Cl. ..... 69/48
(58) Field of Search ..... 69/48, 1, 29, 30, 69/37, 39, 42, 43; 68/253 R, 244, 251, 253 C

(56) References Cited

U.S. PATENT DOCUMENTS

| | | | | | |
|---|---|---|---|---|---|
| 810,510 | A | | 1/1906 | Robins, Jr. | |
| 3,654,781 | A | * | 4/1972 | Plechac | 69/41 |
| 4,055,059 | A | * | 10/1977 | Dokoupil | 69/41 |
| 4,280,345 | A | | 7/1981 | Gimelfarb et al. | |
| 4,333,731 | A | | 6/1982 | Schindlmayr et al. | |
| 4,559,793 | A | | 12/1985 | Geweniger | |
| 4,643,916 | A | | 2/1987 | Kiuchi | |
| RE33,034 | E | | 8/1989 | Schiel et al. | |
| 4,888,966 | A | * | 12/1989 | Zapfel et al. | 69/41 |
| 5,000,017 | A | | 3/1991 | Petersen | |
| 5,238,537 | A | | 8/1993 | Dutt | |
| 5,868,798 | A | | 2/1999 | Anderson et al. | |
| 6,174,825 | B1 | | 1/2001 | Dutt | |
| 6,371,280 | B1 | | 4/2002 | Lindner | |
| 6,387,135 | B1 | | 5/2002 | Anderson | |
| 6,428,874 | B1 | | 8/2002 | McGahern et al. | |

* cited by examiner

*Primary Examiner*—Danny Worrell
(74) *Attorney, Agent, or Firm*—Frommer Lawrence & Haug LLP; Ronald R. Santucci

(57) ABSTRACT

An extended nip press machine, similar to those used in the paper industry, for use in the leather industry to remove water from hides after the tanning process. The leather press consists of a shoe whose surface substantially matches the radius of an opposing pressure roll. Moving across the shoe is an endless belt, which is lubricated by a thin film of oil. Between the belt and corresponding pressure roll pass two endless felt belts, which are the means of conveying the leather hides. The nip formed by the shoe press is dramatically longer than a conventional press nip, thereby increasing the dewatering efficiency of the leather press.

17 Claims, 4 Drawing Sheets

EXTENDED NIP PRESS FOR THE LEATHER INDUSTRY

BACKGROUND OF THE INVENTION

1. Field of the Invention

The present invention relates to the leather tanning arts. More specifically, the present invention relates to a long nip press for drying tanned leather hides.

2. Description of the Prior Art

Leather tanning is the process of converting raw hides or skins into leather. Hides and skins have the ability to absorb tannic acid and other chemicals that prevent them from decaying. FIG. 1 is a general flow diagram of the leather tanning and finishing process. The raw hides are "cured," a process which involves salting and/or drying the hide once its been stripped from the animal.

The first steps, commonly referred to as the "beamhouse" operations 10, prepare the hides for tanning 20. The cured hides are trimmed and soaked to remove salt and other solids, and to restore moisture lost during curing. The hides are then fleshed to remove excess tissue and impart a uniform thickness. The hair is removed from the hides by soaking in a lime/water mixture to loosen the hairs and then mechanically removing the loosened hairs.

These prepared hides are now ready for the tanning operations 20. Tanning may be performed using either trivalent chromium salts or vegetable tannins extracted from specific tree barks. Chrome tanned leather is softer, more pliable, and quicker to produce than vegetable tanned leather. Chrome tanning is performed using a one-bath process that is based on the reaction between the hide and the chromium salt.

Following chrome tanning, the tanned leather is wrung (or sammied) to dry the hide. This process of removing excess water from a hide is known as dewatering. The tanning liquors and water baths used on the hides in the tanning process saturate the hide with moisture. The wringing process reduces this water content to about 55% and can be achieved by a variety of machines. Wringing machines typically consist of two large rolls, which squeeze excess from the hide. Other common machines use a large mangle with felt covered rollers to press the hide.

After wringing, the tanning process may be repeated and/or dyes may be applied. The tanned hide is then oiled (i.e. fat liquoring) to replace natural oils lost during the tanning process. The leather is dried again, to a 10–20% water content, by one of several methods (air drying, drying in a toggling or pasting unit, vacuum drying, or high-frequency drying) and is ready for finishing.

Finishing processes 30 include conditioning, staking, dry milling, buffing, spray finishing, and plating. Leathers may be finished in a variety of ways including: buffing to produce a suede finish; lacquering to produce a glossy patent leather finish; and waxing, shellacking, or treating with pigments, dyes and resins to achieve a smooth colored finish.

As mentioned, the leather industry uses large presses to wring excess water from the hides after the tanning operation is complete. These machines typically use large rubber covered squeeze rolls juxtaposed in close proximity on another. Two felt belts pass between the squeeze rolls with a wet hide sandwiched in between. FIG. 2 is a side cross-sectional diagram of a conventional leather press having a center top roll 200 in contact at two short pressure points 240 (or nips) with two lower rolls 210. The top roll and the bottom rolls are contained within the rotating felt belts 220 and 230 respectively. The hides are fed between the rolls by the felt belts and excess water is squeezed out at the nips.

The more rolls that are in a press; the more press nips can be formed and the more efficient the press is in removing water from the hides. For example, one roll over two rolls produces two press nips (as shown in FIG. 2), whereas two rolls over three rolls produces four press nips. Another aspect of dewatering the hide is the width of the nip. The larger the roll diameter the wider the nip. The hardness of the roll cover also plays a part in the nip width. The softer the cover the wider the nip. Thus, machine size is a function of the number of rolls, the size of the rolls, and the roll cover material. However, more rolls typically means a higher cost machine.

Regardless of the number of rolls, the leather press must precisely control the pressure applied to the hides. Too much pressure on a saturated hide can rupture the grained (flowered) side as water is intended to exit the hide in only one direction, which is to the flesh side.

Further, the dewatering process is dependent on the efficiency of the belts in carrying the expelled water away from the hide. Hence, the felt belts must be able to handle the amount of water being pressed from the leather hide during the wringing process.

Therefore, a need exists for a wringing/press device for dewatering hides in the leather industry that is compact and cost efficient yet has a high dewatering efficiency.

SUMMARY OF THE INVENTION

The present invention is a device for dewatering tanned hides in the leather industry. The device provides a solution to the problem of efficiently expelling water from the leather hide during the wringing process.

A preferred embodiment of the present invention is a press device for use in the leather industry having an extended (long) nip for dewatering hides. The device has a press roll having a smooth cylindrical surface and a pressure shoe having a cylindrically concave surface whose radius of curvature is substantially similar to that of the press roll. The pressure shoe is in close physical proximity to the press roll, thereby forming the extended nip between the press roll and the pressure shoe. A hydraulic means is operatively attached to the pressure shoe to adjust the distance between the press roll and the pressure shoe, thereby controlling the pressure in the extended nip. A press belt encircles and slides over the pressure shoe on a lubricating film of oil. The press belt is impermeable to oil and has grooves or other surface voids on its outer surface. A first felt belt encircles and rotates about the press roll. A second felt belt encircles the shoe press belt and rotates about the pressure shoe. The shoe press belt prevents the second felt belt from directly sliding against the pressure shoe. Wet hides are placed between the first and second felt belts and conveyed through the extended nip. The extended nip presses water from the hides through the felt belts; and more specifically, through the second felt belt where the water is channeled away via the grooves in the impermeable shoe press belt.

Other aspects of this embodiment include that the extended nip may be at least five times longer in the machine direction than a conventional press nip formed between two press rolls. The extended nip acts to increase the dwell time of the hide in the press nip while maintaining a desired pressure level. In this manner, the extended nip increases the dewatering efficiency of the hides over a conventional press nip. The grooves on the outer surface of the press belt preferably run in the machine direction, but also may run in the cross-machine direction, in order to provide sufficient drainage to channel the water pressed from the hides. The first and second felt belts may be endless woven, or woven and seamed fabrics.

Another embodiment of the present invention is a shoe press belt for use on an extended nip press to dewater hides in the leather industry. The shoe press belt is characterized by machine direction grooves on an outer surface of the press belt, thereby providing drainage to channel water pressed from the hides. Cross-machine direction grooves may also be present. The shoe press belt is impermeable to oil, and encircles and slides over a pressure shoe in the extended nip press on a lubricating film of oil. The shoe press belt prevents an encircling felt belt in the extended nip press from directly sliding against the pressure shoe.

Other aspects of this embodiment include that the shoe press belt typically has a base support structure generally taking the form of an endless loop having an inner surface, outer surface, and having a defined thickness. The base support structure is formed from a plurality of elements coated with a polymeric resin material. This base support structure may be a woven base fabric impregnated with a synthetic polymeric resin. The base support structure should be stable and resistant to stretching in both the machine direction and cross-machine direction. The synthetic polymeric resin should also be of an elastomeric material having a hardness sufficient to maintain groove integrity and flexible enough to resist cracking.

The shoe press belt typically has a length of 9 to 20 feet and a width as required by the dewatering press itself. The inside surface of the shoe press belt is preferably a smooth, impervious surface to slide readily over the lubricated pressure shoe and to prevent any of the lubricating oil from penetrating the belt and contaminating the hides being pressed.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
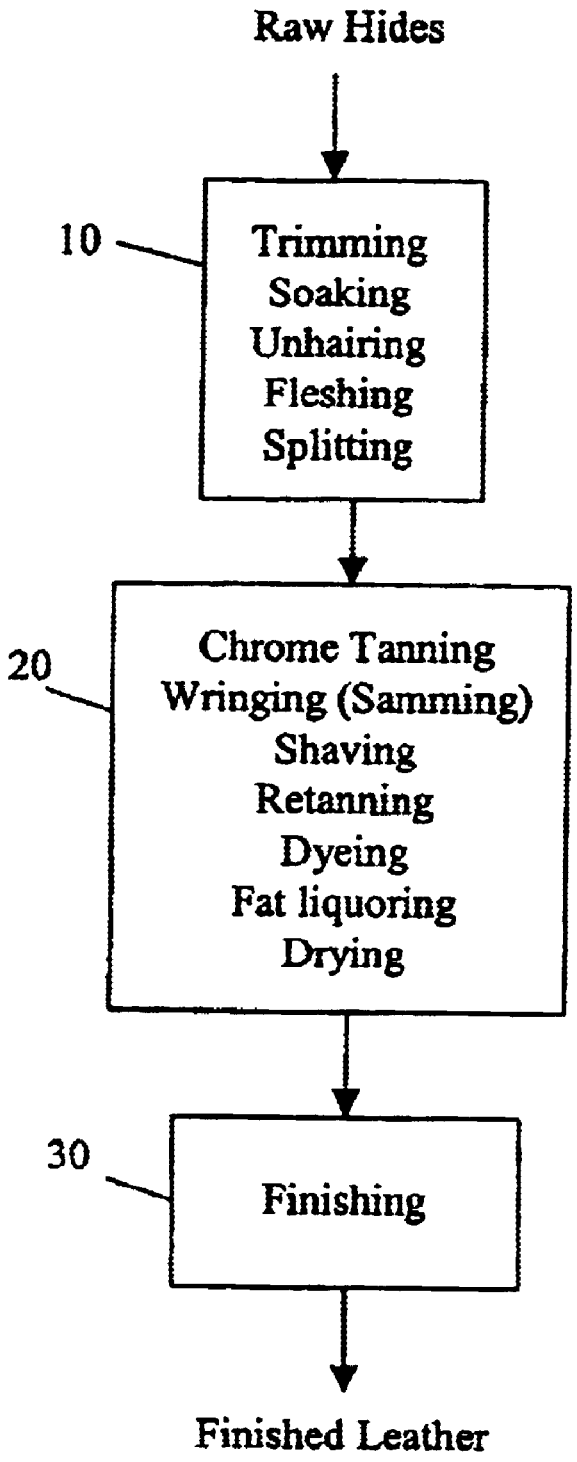
FIG. 1 is a flow diagram of the leather tanning process.
Figure 2:
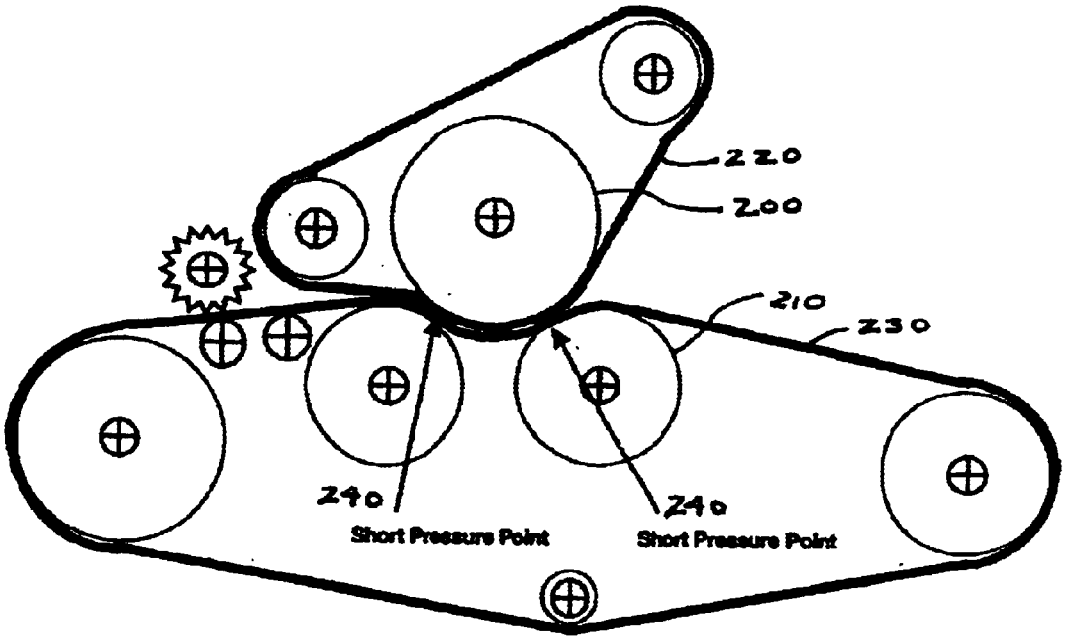
Figure 2 PRIOR ART
FIG. 2 is a side cross-sectional diagram of a conventional leather press having two short pressure points.

A preferred embodiment of the present invention is an extended nip press that efficiently removes water from tanned hides during the wringing/samming operation. The concept of an extended nip press, or shoe press, has been known in the paper industry since the early 1980s. The shoe press replaces the conventional double opposing roll concept. In place of one of the rolls, a curved steel shoe is positioned that substantially matches the radius of an opposing roll. Upon the shoe surface rides an endless belt coated with an elastomeric compound. A thin oil film lubricates the shoe/belt interface. This concept is commonly referred to as a "fluid bearing." Pressure between the steel shoe and the roll is created by a hydraulic system exerting a force on the steel shoe. The opposing roll is in a fixed position.

In the paper industry, paper is formed by depositing a fibrous slurry onto a moving forming fabric. The paper passes through press nips supported by a press fabric, or, as is often the case, between two such press fabrics. In the press nips, the paper is subjected to compressive forces which squeeze water therefrom, and which adhere the fibers to one another. The water is accepted by the press fabric or fabrics and, ideally, does not return to the paper sheet.

In recent years, the paper industry has found that long nip (or extended nip) presses are advantageous over the use of nips formed by pairs of adjacent press rolls. This is because the longer the time a paper sheet can be subjected to pressure in the nip, the more water can be removed there, and, consequently, the less water will remain behind in the sheet for removal through evaporation in the dryer section. The width of the nip created between the roll and a steel shoe is 5 to 10 times the length of a standard roll nip. The paper industry has found that this extended nip type of press increases the dewatering efficiency by 20% to 30% over conventional two-roll presses, depending on the paper grade.

The present invention applies this shoe press concept to a leather press to increase the efficiency of dewatering the leather hides after tanning. The difference between the papermaking process and the leather pressing process lies in the pressure distribution and the amount of water to be removed. With a leather hide, the quantity of water to be removed is 50 times that removed from a sheet of paper.

The present device, after tanning, squeezes water from leather hides between felt belts on a belt shoe press. The shoe press has a steel shoe whose surface matches the radius of an opposing pressure roll. Moving across the shoe is an endless belt lubricated by a thin film of oil on the steel shoe surface. The belt surfaces are impervious to oil and water. Between the belt and the corresponding pressure roll pass two endless felt belts which are the means of conveying the leather hides. The pressure of the roll against the shoe is transmitted through the felt belts and provides the means for the removal of water from the hides after the tanning process.

The shoe of the present leather press is designed to provide pressure to the hide in a controlled manner. Too much pressure on a saturated hide can rupture the grain (flowered) side as water is intended to exit the hide in only one direction. The contour of the steel shoe is designed to create this controlled pressure ramping.

Figure 3:
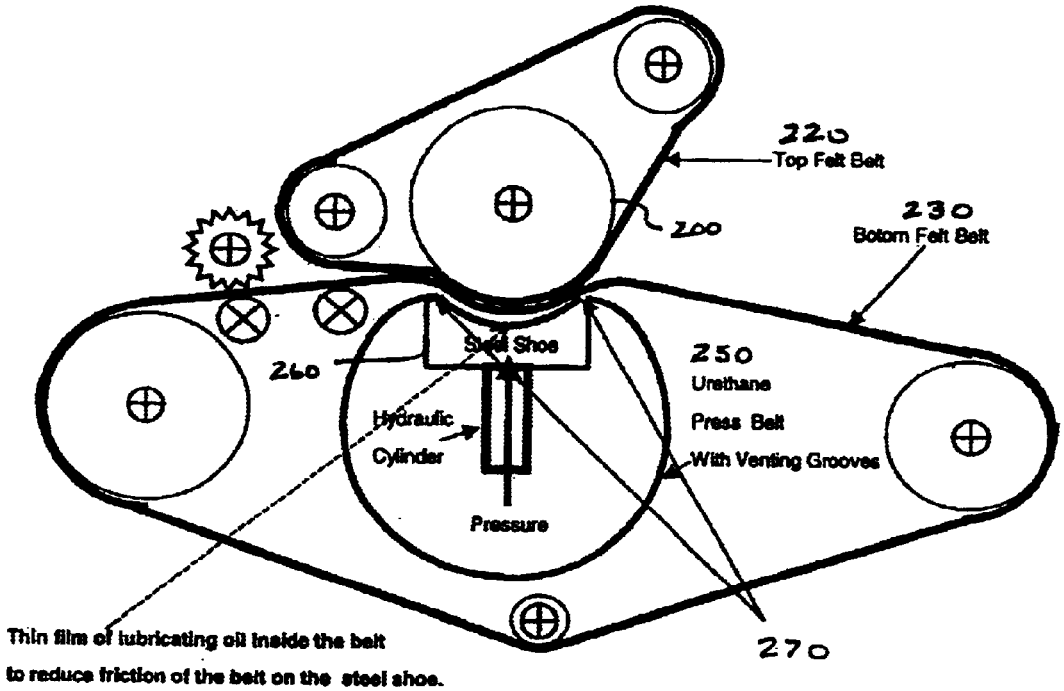
FIG. 3 is a side cross-sectional diagram of a belted shoe press having an extended pressing zone.

FIG. 3 is a side cross-sectional diagram of a belted shoe press having an extended pressing zone in accordance with the present invention. The extended press nip 270 is defined by a smooth cylindrical press roll 200 and an arcuate pressure shoe 260. The arcuate pressure shoe 260 has a cylindrically concave surface having a radius of curvature close to that of the cylindrical press roll 200. Smooth cylindrical press roll 200 may be a controlled crown roll matched to the arcuate pressure shoe 260 to obtain a level cross-machine nip profile. The distance between the cylindrical press roll 200 and the arcuate pressure shoe 260 may be adjusted by hydraulic means operatively attached to the arcuate pressure shoe to control the loading of the nip. When the roll and shoe are brought into close physical proximity to one another an extended nip is formed, which can be five to ten times longer in the machine direction than one formed between two press rolls. This nip can be up to approximately twenty inches (500 mm) in length. This increases the so-called dwell time of the hide in the nip while maintaining an adequate level of pressure per square inch of pressing force. The result of this extended nip technology is a dramatic increase in dewatering of the hide in the extended nip when compared to conventional press nips.

The shoe press belt 250 extends in a closed loop through the extended nip 270 separating the cylindrical press roll 200 from the arcuate pressure shoe 260. A wet, tanned hide passes between the top felt belt 220 and the bottom felt belt 230 through the extended nip. The shoe press belt 250 also moves through the press nip 270 and prevents the bottom felt belt 230 from directly sliding against the pressure shoe 260, sliding thereover on a lubricating film of oil. Accordingly, the shoe press belt 250 must be impermeable to oil, so that the bottom felt belt 230 and hide are not contaminated thereby.

A long nip press of the shoe type requires a special belt, such as that taught in commonly assigned U.S. Pat. Nos. 5,238,537 and 6,174,825 to Dutt, which are directed to use in the papermaking industry. This belt is designed to protect the press fabric supporting, carrying and dewatering the paper sheet from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 6,174,825 are made by impregnating a base substrate, which takes the form of an endless loop, with a synthetic polymeric resin. Preferably, the resin forms a coating of some predetermined thickness at least on the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or material being pressed. The coating must also be present on the other side of the belt so that voids—such as grooves—that allow dewatering can be present.

Shoe press belts, for the closed loop press types, depending on the size requirements of the presses on which they are installed, have lengths from roughly 9 to 20 feet (approximately 3 to 6 meters), measured longitudinally around their endless-loop forms, and widths as required by the hide dewatering apparatus, measured transversely across those forms.

As described above, the use of a shoe press in the leather tanning process will dramatically increase the dewatering efficiency in the wringing operation. An important aspect of such an extended nip leather press is the development of a belt which can properly channel the extracted water away from the hide. This is because the amount of water expelled from a leather hide during the pressing operation greatly exceeds that which is removed in the paper industry. Normally, a paper industry shoe press belt will have either blind drilled holes or machine direction grooves or a combination of both to channel water away from the paper. This channeling system probably is not adequate to expel the water in the pressing zone of an extended nip leather press.

Figure 4:
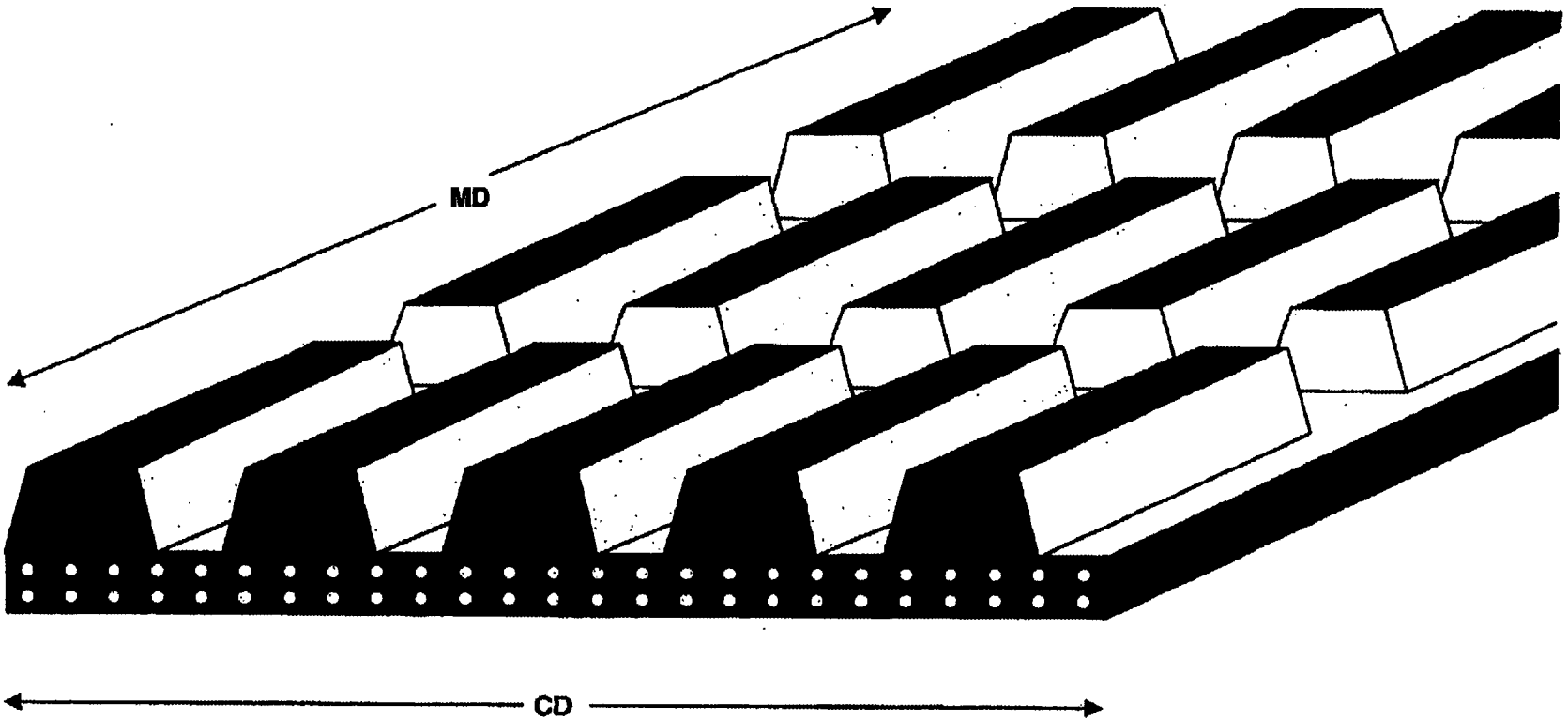
FIG. 4 is a perspective cross-sectional close-up view of a grooved shoe press belt for use in the belted shoe press shown in FIG. 3.

Accordingly, the present leather shoe press belt, unlike shoe press belts in the paper industry, must have greater void volume to allow more water to be pressed from the hide. Void volume can be increased by using a larger number of grooves, wider grooves, deeper grooves, more blind drilled holes, or a combination of grooves and holes. A preferred embodiment however has grooves in both the machine direction (MD) and cross-machine direction (CD) to provide a sufficient void volume for the water removed from the hide. FIG. 4 is a perspective cross-sectional close-up view of a grooved leather shoe press belt for use in the belted shoe press shown in FIG. 3.

The present belt includes a base support structure generally taking the form of an endless loop having an inner surface, an outer surface, a longitudinal direction and a transverse direction. The base support structure is formed, for example, from a woven fabric of polymeric yarns coated with a first polymeric resin material, which may be a polyurethane resin material. The base support structure may also be assembled by knitting, braiding or the like.

The thickness of the leather shoe press belt is to a degree dependent on the amount of void volume required within the grooves and or holes in order to carry away the water wrung from the hide. The thicker the belt, the deeper the grooves can be in one or both the MD and CD, thus providing larger channels for the water to be expelled. Of course, the grooved side of the belt must remain impervious to the passage of fluid and maintain the integrity of the grooves throughout its life.

Accordingly, the inside surface of the belt must be resistant to oil and provide a smooth surface to allow low-friction passage through the shoe zone, while passing in and out of the shoe nip. The shoe press belt must also be stable and resist stretching in both the MD and CD. The hardness of the elastomeric material should be in the range that is hard enough to maintain groove integrity and yet soft enough to be able to flex over the in-going and out-going shoe edges without cracking.

Another aspect of the present extended nip press includes a means for clamping or sealing the shoe press belt to the shoe roll assembly to keep the oil in and the water out which can be done by methods known to those in the art of papermaking shoe presses, such as, for example, in U.S. Pat. No. Re. 33,034, the disclosure of which is incorporated herein by reference.

The present shoe press belt yarns themselves may be of any of the yarn varieties used by those of ordinary skill in the art to produce paper machine clothing or other textiles. Monofilament yarns are preferred, although plied monofilament, multifilament, plied multifilament, knitted and braided yarns may also be used. The yarns may be of any of the polymeric resins from which yarns for paper machine clothing or leather tanning are commonly extruded or produced, such as polyamide, polyester, polyetheretherketone (PEEK), polyaramid (for example, KEVLAR® and NOMEX®) and polyolefin resins.

The base fabric of the belt may also include a staple fiber batt needled or otherwise entangled into the woven structure thereof. Such a staple fiber batt may comprise fibers of a polymeric resin material, such as polyamide or polyester, or of any of the other materials commonly used for this purpose by those in the paper machine clothing or leather tanning industry.

Modifications to the above would be obvious to those of ordinary skill in the art, but would not bring the invention so modified beyond the scope of the present invention. The claims to follow should be construed to covet such situations.

What is claimed is:

1. A press device for use in the leather industry having an extended nip for dewatering hides, comprising:

a press roll having a smooth cylindrical surface;

a pressure shoe having a cylindrically concave surface whose radius of curvature is substantially similar to that of the press roll; the pressure shoe being in close physical proximity to the press roll, thereby forming the extended nip between the press roll and the pressure shoe;

hydraulic means operatively attached to the pressure shoe to adjust the distance between the press roll and the pressure shoe to control a pressure of the extended nip;

a shoe press belt encircling and sliding over the pressure shoe on a lubricating film of oil; the shoe press belt being impermeable to oil and having grooves on an outer surface thereof;

a first felt belt encircling and rotating about the press roll; and a second felt belt encircling the press belt and rotating about the pressure shoe; wherein the shoe press belt prevents the second felt belt from directly sliding against the pressure shoe;

wherein wet hides are placed between the first and second felt belts and conveyed through the extended nip; the extended nip pressing water from the hides through the second felt belt where the water is channeled away via the grooves in the shoe press belt.

2. The device of claim 1, wherein the extended nip is at least five times longer in the machine direction than a conventional press nip formed between two press rolls.

3. The device of claim 1, wherein the extended nip increases the dwell time of the hide in a press nip while maintaining a desired pressure level.

4. The device of claim 1, wherein the extended nip increases the dewatering efficiency of the hides over a conventional press nip.

5. The device of claim 1, wherein the grooves in the shoe press belt run in both the machine direction and cross-machine direction on the outer surface of the shoe press belt, thereby providing sufficient voids and/or paths to channel the water pressed from the hides.

6. The device of claim 1, wherein the first and second felts belts are endless woven or seamed fabrics.

7. A shoe press belt for use on an extended nip press to dewater hides in the leather industry, characterized by machine direction grooves and cross-machine direction grooves on an outer surface of the shoe press belt, thereby providing voids and/or paths to channel water pressed from the hides.

8. The shoe press belt of claim 7, wherein the shoe press belt is impermeable to oil, and encircles and slides over a pressure shoe in the extended nip press on a lubricating film of oil.

9. The shoe press belt of claim 8, wherein the shoe press belt prevents an encircling felt belt in the extended nip press from directly sliding against the pressure shoe.

10. The shoe press belt of claim 8, wherein the shoe press belt has a base support structure generally taking the form of an endless loop having an inner surface, the outer surface, and having a defined thickness.

11. The shoe press belt of claim 10, wherein the base support structure is a woven, knitted, or braided base fabric impregnated with a synthetic polymeric resin.

12. The shoe press belt of claim 11, wherein the synthetic polymeric resin has a hardness sufficient to maintain groove integrity and flexible enough to resist cracking.

13. The shoe press belt of claim 10, wherein the base support structure is stable and resistant to stretching in both the machine direction and cross-machine direction.

14. The shoe press belt of claim 10, wherein the defined thickness of the shoe press belt is based on the required depth of the machine direction grooves and cross-machine direction grooves to channel the water pressed from the hides.

15. The shoe press belt of claim 10, wherein the inside surface of the shoe press belt is a smooth, impervious surface to slide readily over the lubricated pressure shoe and to prevent any of the lubricating oil from penetrating the belt and contaminating the hides being pressed.

16. The shoe press belt of claim 7, wherein the shoe press belt has a length of 9 to 20 feet and a width sufficient for the press device.

17. The shoe press belt of claim 10, wherein the base support structure includes a staple fiber batt of a polymeric resin material needled into the structure thereof.

* * * * *